US008827279B1

(12) United States Patent
Clark

(10) Patent No.: US 8,827,279 B1
(45) Date of Patent: Sep. 9, 2014

(54) HORSE RIDING SIMULATION SYSTEM

(71) Applicant: Michele Clark, Hudson, FL (US)

(72) Inventor: Michele Clark, Hudson, FL (US)

( * ) Notice: Subject to any disclaimer, the term of this patent is extended or adjusted under 35 U.S.C. 154(b) by 0 days.

(21) Appl. No.: 13/771,387

(22) Filed: Feb. 20, 2013

Related U.S. Application Data

(60) Provisional application No. 61/613,978, filed on Mar. 21, 2012.

(51) Int. Cl.
*A63G 19/20* (2006.01)
*A63H 17/26* (2006.01)

(52) U.S. Cl.
CPC ..... *A63H 17/26* (2013.01); *A63G 19/20* (2013.01)
USPC ..... 280/1.202; 280/1.206; 180/210

(58) Field of Classification Search
USPC ..... 280/1.201, 1.202, 1.203, 1.206, 1.13, 280/1.14, 1.22, 229; 180/216, 210; 446/29, 446/269, 270, 279, 289, 313, 352
See application file for complete search history.

(56) References Cited

U.S. PATENT DOCUMENTS

| | | | | | |
|---|---|---|---|---|---|
| 883,746 | A | * | 4/1908 | Robbins | 280/229 |
| 985,369 | A | * | 2/1911 | Robbins | 280/229 |
| 1,011,204 | A | * | 12/1911 | Jamison | 280/225 |
| 1,308,425 | A | * | 7/1919 | Johnson | 180/65.1 |
| 1,371,472 | A | * | 3/1921 | Costello | 152/310 |
| 1,385,320 | A | * | 7/1921 | Frick | 280/1.195 |
| 1,449,163 | A | * | 3/1923 | Brandes | 280/1.192 |
| 1,498,427 | A | * | 6/1924 | Dean | 280/1.192 |
| 1,553,219 | A | * | 9/1925 | Crosby | 280/1.182 |
| 1,570,330 | A | * | 1/1926 | Boyed | 280/87.021 |
| 1,614,366 | A | * | 1/1927 | Holloway | 280/225 |
| 1,759,740 | A | * | 5/1930 | Foltz | 280/1.192 |
| 1,808,887 | A | * | 6/1931 | Dunkley | 280/1.192 |
| 1,863,393 | A | * | 6/1932 | Brennan | 280/1.192 |
| 1,877,040 | A | * | 9/1932 | Pascetti | 280/1.192 |
| 1,939,989 | A | * | 12/1933 | Kopsco | 280/223 |
| 2,195,824 | A | | 4/1940 | Ochoa | |
| 2,224,689 | A | * | 12/1940 | Middler et al. | 280/1.194 |
| 2,253,096 | A | * | 8/1941 | Sheldon | 280/1.195 |
| 2,436,886 | A | * | 3/1948 | Gowland | 446/189 |
| 2,474,870 | A | * | 7/1949 | Sheldon | 280/1.195 |
| 2,503,655 | A | * | 4/1950 | Cokins | 446/277 |
| 2,691,845 | A | * | 10/1954 | Jepson | 40/411 |
| 2,740,636 | A | * | 4/1956 | Dix | 280/1.14 |
| 2,785,905 | A | * | 3/1957 | Spohn | 280/1.192 |
| 2,823,920 | A | * | 2/1958 | Seger | 280/1.196 |
| 2,837,342 | A | * | 6/1958 | Kirk | 280/1.189 |
| 2,883,202 | A | * | 4/1959 | Morgan | 280/1.194 |
| 2,885,213 | A | | 5/1959 | Glumer | |
| 2,904,343 | A | * | 9/1959 | Taber | 280/43.18 |

(Continued)

*Primary Examiner* — Anne Marie Boehler
*Assistant Examiner* — Maurice Williams

(57) ABSTRACT

A horse riding simulation system for providing a user with a riding experience that resembles riding a horse features a chassis with a rear axle having a first rear wheel and a second rear wheel. The system features a motor centrally located in the chassis operatively connected to a rear axle central drive attachment. The system features a pivoting front steering apparatus with a free rolling front wheel. The system features a front body section having a resemblance to a horse head, chest, shoulders and front legs located over and attached to the front steering apparatus. The system features a rear body section having a resemblance to a horse mid body section, barrel, hips, and rear legs located over and pivotally attached to a chassis top. A seat is located on a rear body top. The system features an operating lever operatively connected to the motor.

6 Claims, 8 Drawing Sheets

(56) References Cited

U.S. PATENT DOCUMENTS

| | | | | | |
|---|---|---|---|---|---|
| 2,982,559 | A | * | 5/1961 | Hawkins | 280/1.182 |
| 2,986,405 | A | * | 5/1961 | Spratt | 280/1.13 |
| 3,010,729 | A | * | 11/1961 | Tomosy | 280/1.181 |
| 3,161,006 | A | * | 12/1964 | Willette et al. | 56/17.2 |
| 3,161,417 | A | * | 12/1964 | Goldfarb | 280/7.1 |
| 3,240,470 | A | * | 3/1966 | Vane, Jr. et al. | 254/419 |
| 3,334,911 | A | * | 8/1967 | Enters | 280/43 |
| 3,350,109 | A | * | 10/1967 | Stanford et al. | 280/1.184 |
| 3,514,117 | A | * | 5/1970 | Olsen | 280/1.192 |
| 4,063,607 | A | * | 12/1977 | Patrick | 180/6.5 |
| 4,289,307 | A | | 9/1981 | Marshall, Jr. et al. | |
| D267,727 | S | | 1/1983 | Doe | |
| 4,657,098 | A | | 4/1987 | Wilcox | |
| 4,666,418 | A | * | 5/1987 | Wolf | 446/273 |
| 4,917,394 | A | * | 4/1990 | Lin | 280/229 |
| 4,957,444 | A | | 9/1990 | Armen | |
| 4,988,300 | A | | 1/1991 | Yamaguchi et al. | |
| 5,249,847 | A | * | 10/1993 | Lee | 301/105.1 |
| 5,307,890 | A | * | 5/1994 | Huang | 180/65.1 |
| 6,186,918 | B1 | * | 2/2001 | Yoo | 474/112 |
| 6,210,167 | B1 | * | 4/2001 | Nishiyama | 434/247 |
| 6,412,787 | B1 | | 7/2002 | Pardi et al. | |
| 6,973,987 | B2 | * | 12/2005 | Damon | 180/68.5 |
| 7,398,843 | B2 | * | 7/2008 | Buehler et al. | 180/8.1 |
| 8,529,310 | B2 | * | 9/2013 | Powers et al. | 446/29 |
| 2002/0163141 | A1 | * | 11/2002 | Pardi et al. | 280/1.202 |
| 2003/0092348 | A1 | * | 5/2003 | Horchler et al. | 446/29 |
| 2005/0098973 | A1 | * | 5/2005 | Pace | 280/87.041 |
| 2007/0114731 | A1 | | 5/2007 | Norton, Jr. | |
| 2007/0287139 | A1 | | 12/2007 | Holm | |

* cited by examiner

HORSE RIDING SIMULATION SYSTEM

CROSS REFERENCE

This application claims priority to U.S. Provisional Patent Application No. 61/613,978, filed Mar. 21, 2012, the specification(s) of which is/are incorporated herein in their entirety by reference.

FIELD OF THE INVENTION

The present invention relates to ride on toys, more specifically, ride on toys resembling animals or horses.

BACKGROUND OF THE INVENTION

The origins of a rideable, movable horse figure may be seen in the rocking cradle, the tilting seats used during the Middle Ages for jousting practice, and the wheeled hobby horse. From the 19th century onward rocking horses became common as a child's toy and were commonly built by hobby woodcrafters. Riding toys with wheels began to gain in popularity with the advent of the motorized automobile around the turn of the $20^{th}$ century. Horse bodies were adapted to the undercarriage of these riding toys for use by those with a stronger interest in horses rather than cars or tractors. A drawback to this type of riding toy is the simplicity of design which limits many facets of the full experience of horseback riding. The present invention features a horse riding simulation system for providing a user with a riding experience that resembles riding a horse.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a horse riding simulation system for providing a user with a riding experience that resembles riding a horse. In some embodiments, the system comprises a chassis with a rear axle located close to a chassis posterior edge. In some embodiments, the system comprises a first rear wheel and a second rear wheel located on the rear axle. In some embodiments, the system comprises a motor centrally located in the chassis operatively connected to a rear axle central drive attachment. In some embodiments, the system comprises a pivoting front steering apparatus located on a chassis anterior edge having a free rolling front wheel. In some embodiments, the system comprises a front body section having a resemblance to a horse head, chest, shoulders and front legs located over and attached to the front steering apparatus. In some embodiments, the front body section comprises a rein located around an anterior end for pivoting the front body section and the attached front steering apparatus. In some embodiments, the system comprises a rear body section having a resemblance to a horse mid body section, barrel, hips, and rear legs. In some embodiments, the rear body section is located over and pivotally attached to a chassis top. In some embodiments, a seat is located on a rear body top. In some embodiments, the system comprises an operating lever operatively connected to the motor.

In some embodiments, a user sits on the seat. In some embodiments, the user activates the operating lever to provide power to the motor via a power source. In some embodiments, the motor propels the system via the first and second rear wheels. In some embodiments, the system is guided via the front steering apparatus and the front wheel.

DESCRIPTION OF PREFERRED EMBODIMENTS

Figure 1:
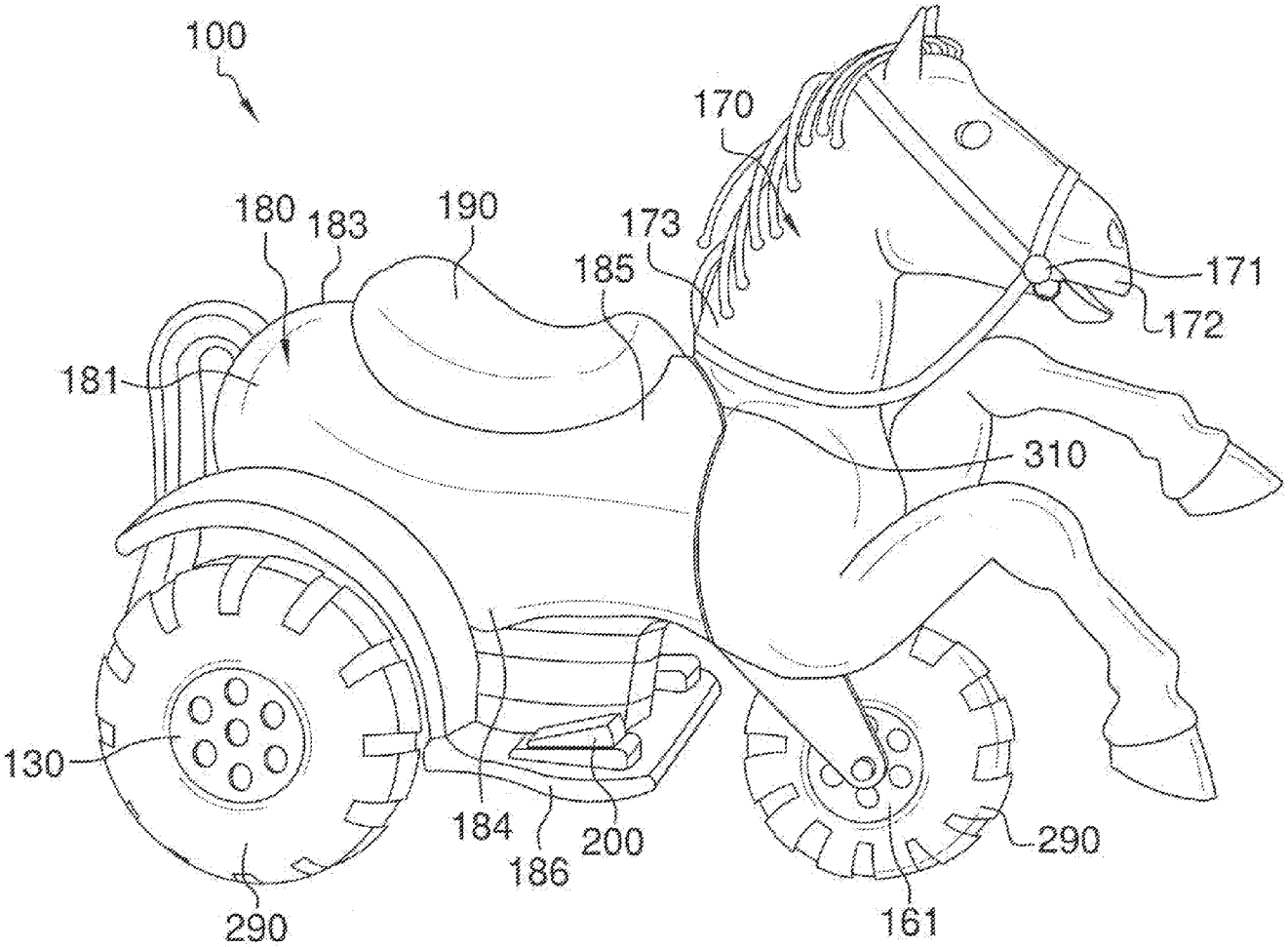
FIG. 1 shows a perspective view of the present invention.

Following is a list of elements corresponding to a particular element referred to herein:

100 Horse riding simulation system
110 Chassis
111 Chassis anterior edge
112 Chassis posterior edge
113 Chassis top
120 Rear axle
121 Rear axle first end
122 Rear axle second end
123 Rear axle central drive attachment
130 First rear wheel
131 First axle mount
132 First rear wheel inside face
140 Second rear wheel
141 Second axle mount
142 Second rear wheel inside face
150 Motor
151 Power source
160 Pivoting front steering apparatus
161 Front wheel
162 Front steering apparatus bottom
163 Plane
170 Front body section
171 Rein
172 Front body section anterior end
173 Front body section posterior end
180 Rear body section
181 Rear body first side
182 Rear body second side
183 Rear body top
184 Rear body bottom
185 Rear body section anterior end
186 First platform
187 Second platform

Figure 2:
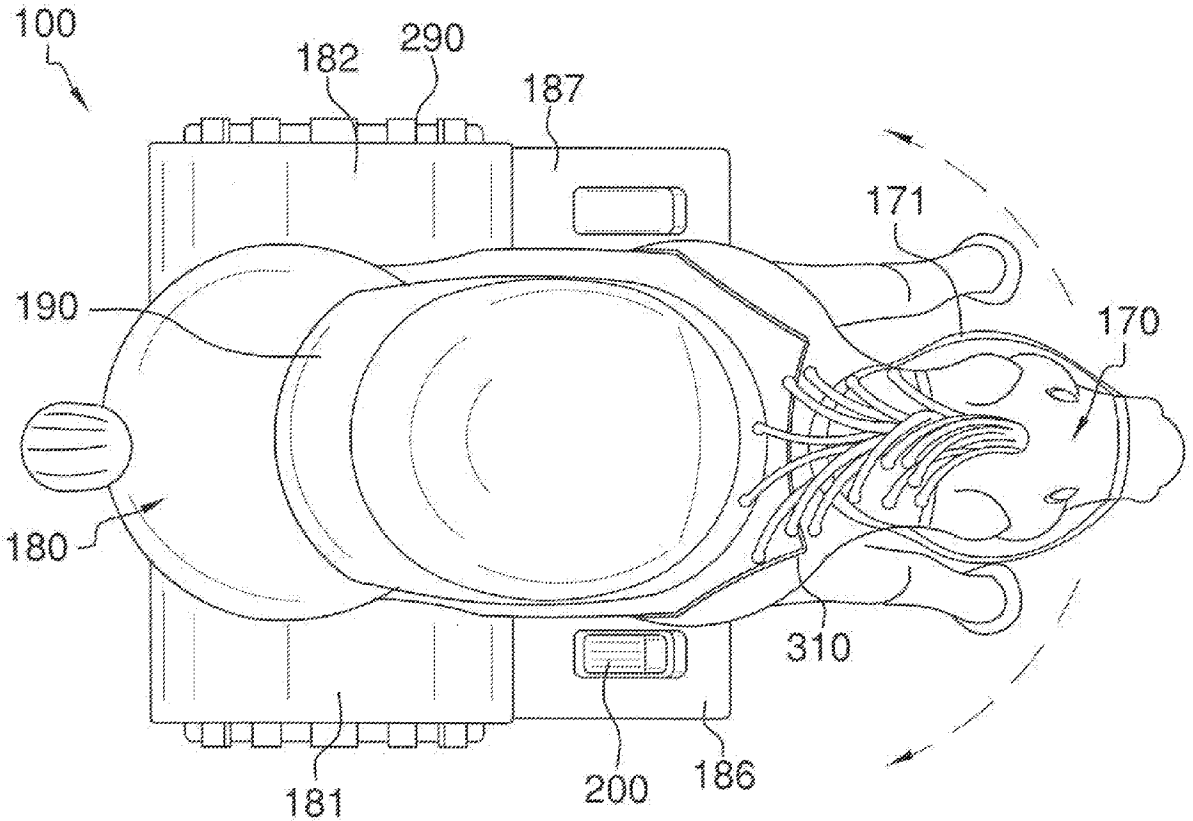
FIG. 2 shows an overhead view of the present invention.
Figure 3:
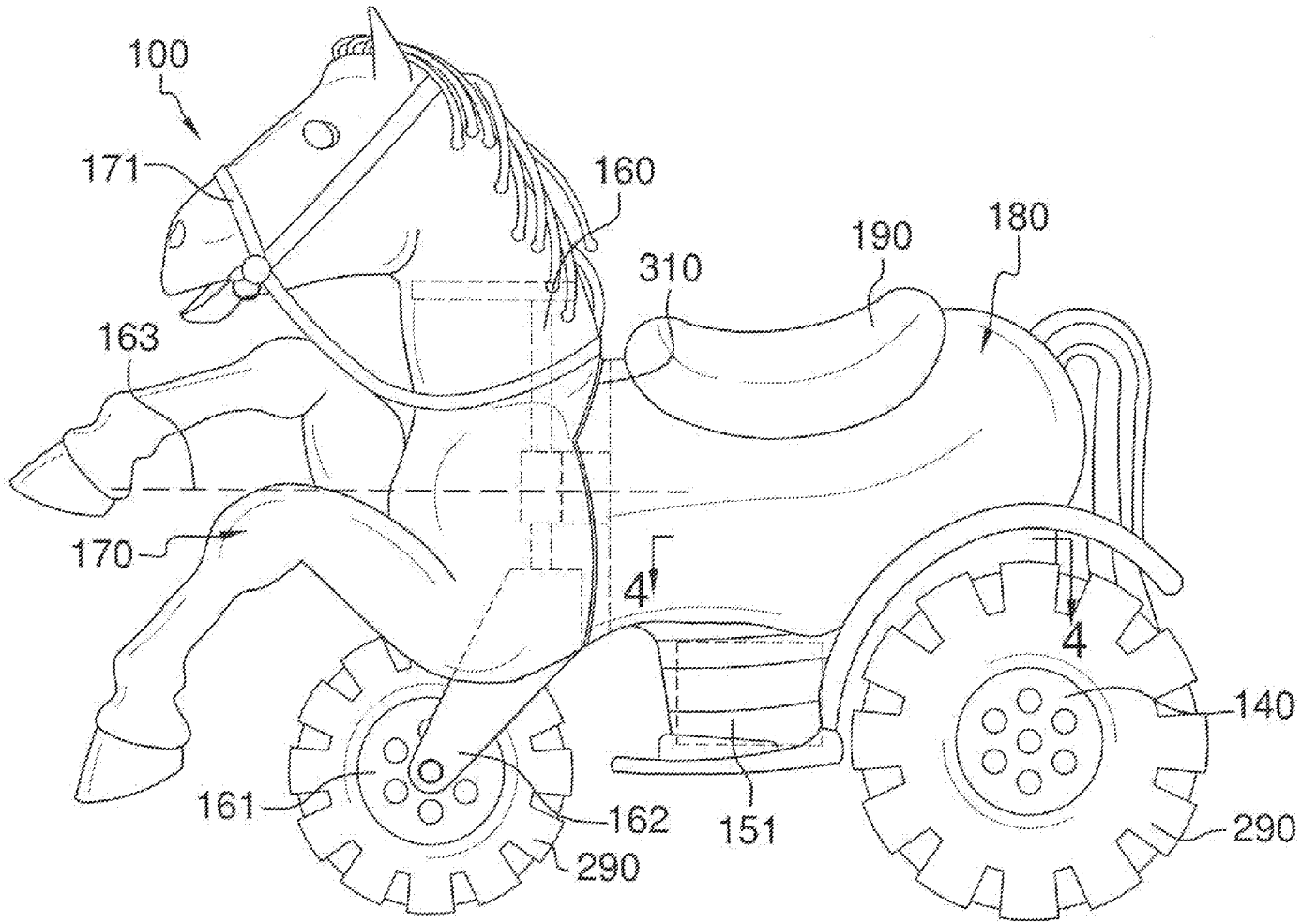
FIG. 3 shows a side view of the present invention.
Figure 4:
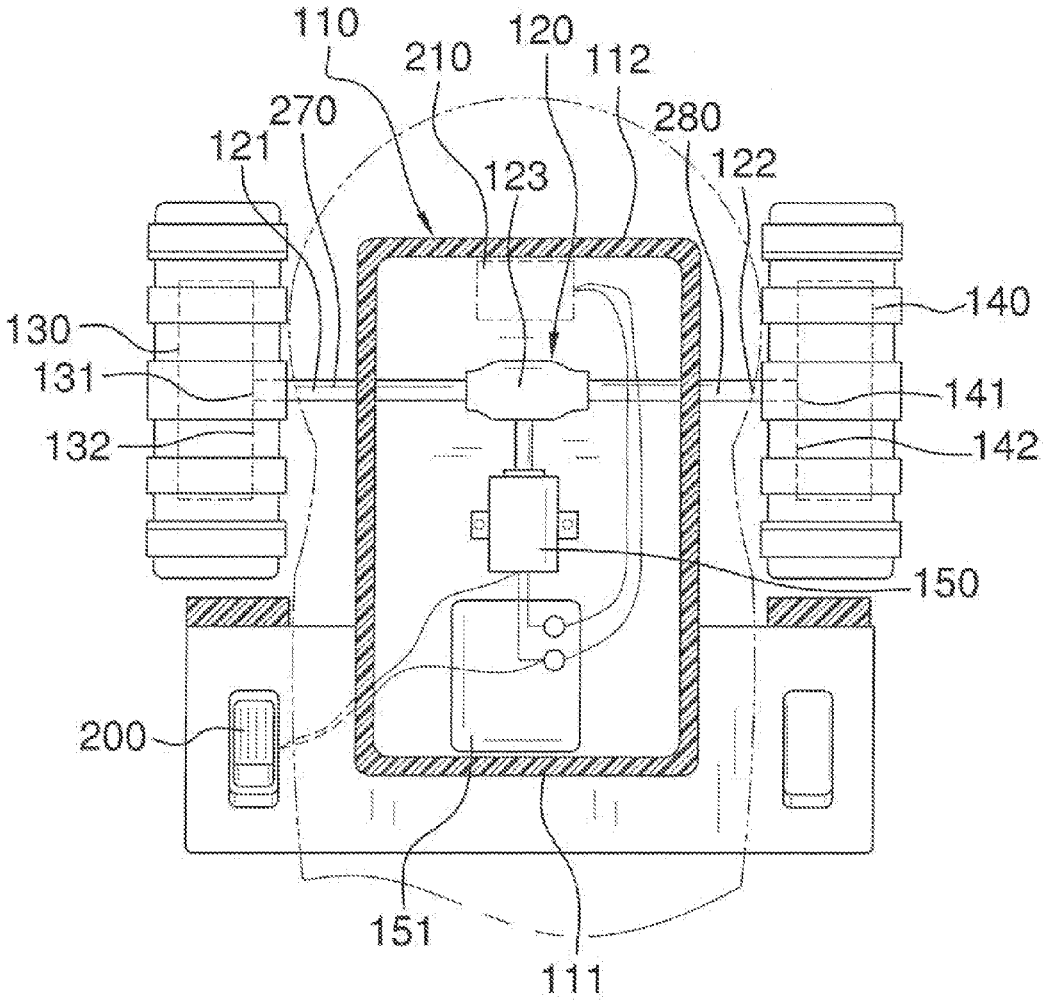
FIG. 4 shows a cross-sectional view in a transverse plane of the present invention.
Figure 5A:
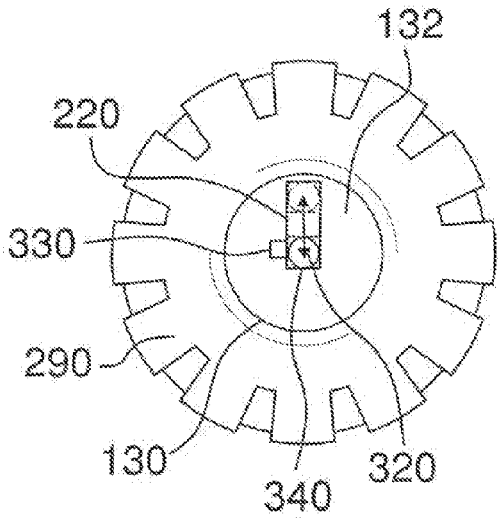
FIG. 5*a* shows an eccentric axle mount of the present invention.
Figure 5B:
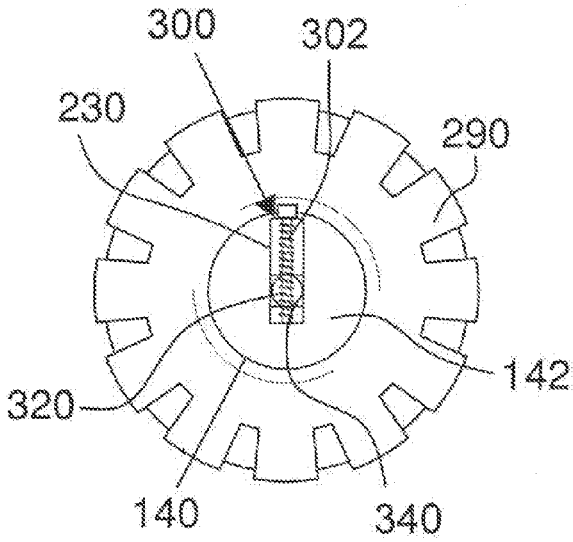
FIG. 5*b* shows an alternate embodiment of the eccentric axle mount of the present invention.
Figure 6:
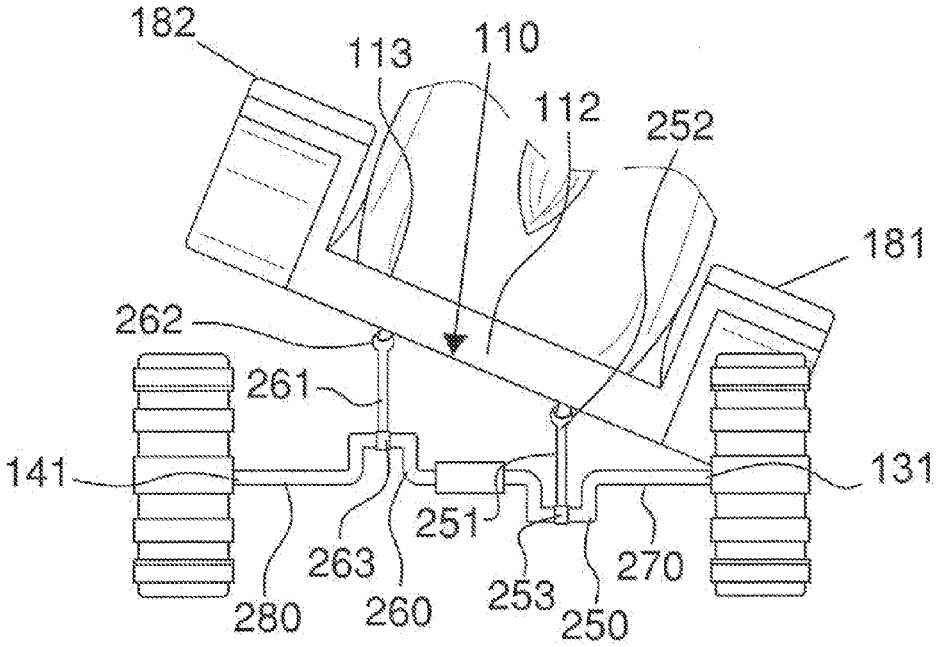
FIG. 6 shows a rear view of the crank and rod of the present invention.
Figure 7:
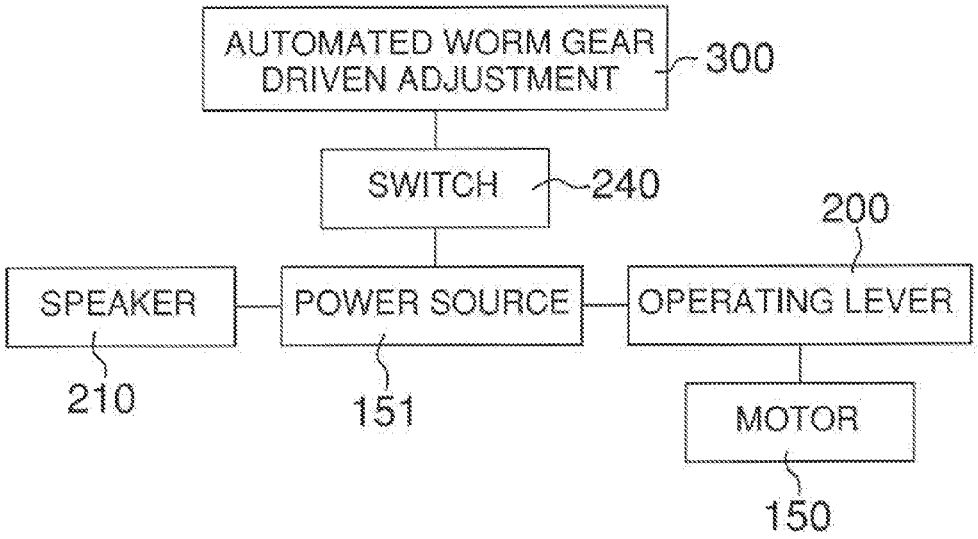
FIG. 7 shows a schematic view of the present invention.
Figure 8:
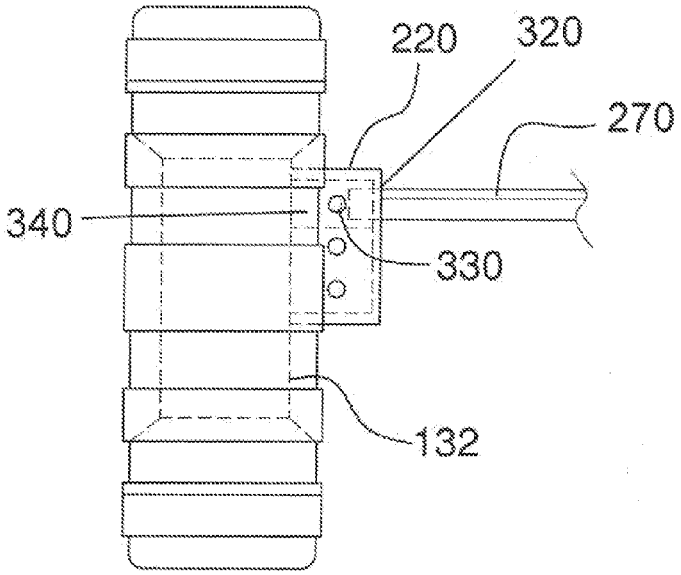
FIG. 8 shows a rear view of the eccentric axle mount of the present invention.
Figure 9:
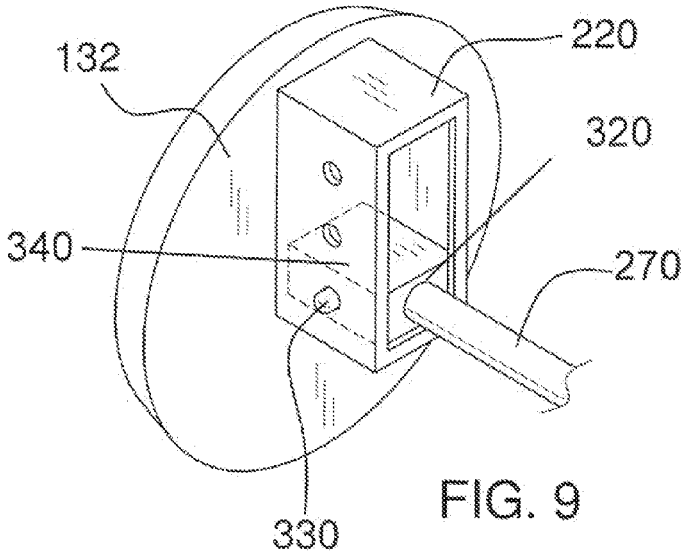
FIG. 9 shows a perspective view of the eccentric axle mount of the present invention.
Figure 10:
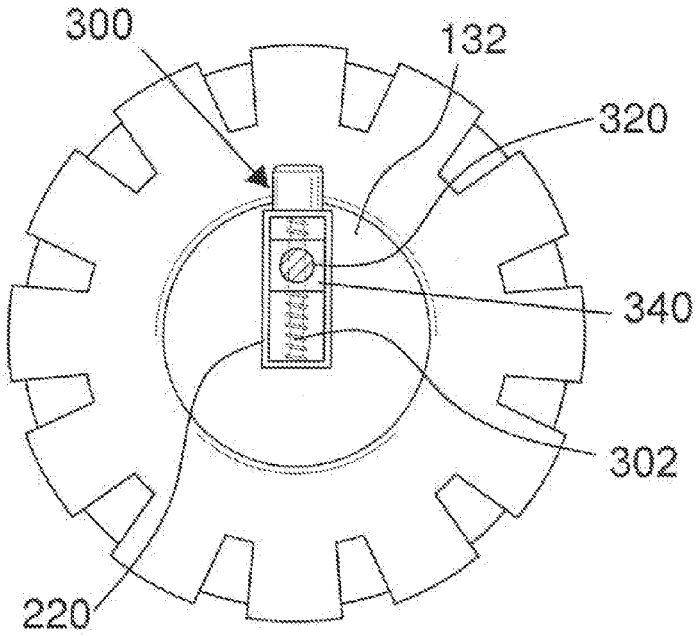
FIG. 10 shows a front side view of the automated worm gear driven adjustment of the present invention.
Figure 11:
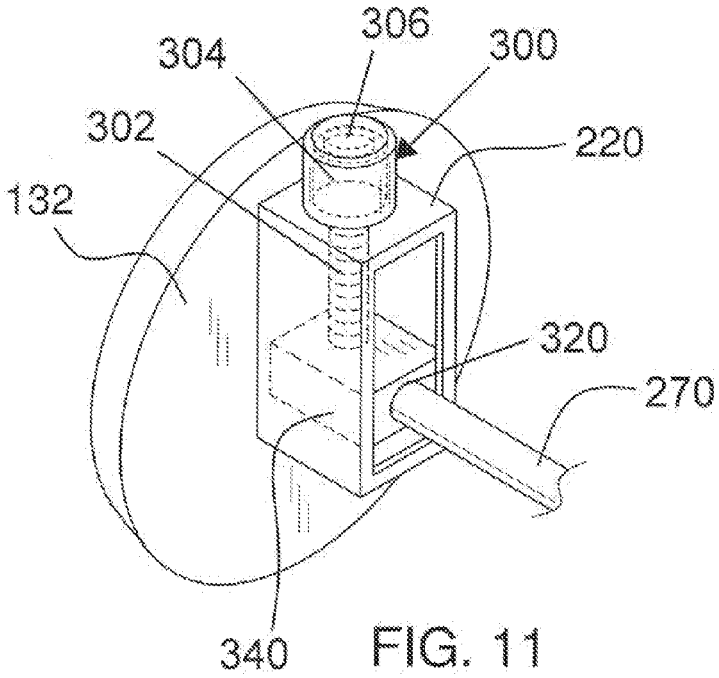
FIG. 11 shows a perspective view of the automated worm gear driven adjustment of the present invention.

190 Seat
200 Operating lever
210 Speaker
220 First adjustable eccentric axle mount
230 Second adjustable eccentric axle mount
240 Switch
250 First crank
251 First rod
252 First rod first end
253 First rod second end
260 Second crank
261 Second rod
262 Second rod first end
263 Second rod second end
270 Rear axle first side
280 Rear axle second side
290 Tire
300 Automated worm gear driven adjustment
302 Worm gear
304 Worm gear motor
306 Worm gear power source
310 Gap
320 Aperture
330 Button
340 Sliding block Referring now to FIG. 1-11, the present invention features a horse riding simulation system (100) for providing a user with a riding experience that resembles riding a horse. In some embodiments, the system (100) comprises a chassis (110) having a chassis anterior edge (111) and a chassis posterior edge (112). In some embodiments, the chassis (110) comprises a rear axle (120) located close to the chassis posterior edge (112). In some embodiments, the rear axle (120) comprises a rear axle first end (121), a rear axle second end (122), and a centrally located rear axle central drive attachment (123). In some embodiments, the rear axle central drive attachment (123) comprises adjustable gearing.

In some embodiments, the system (100) comprises a first rear wheel (130) having a first axle mount (131) centrally located on an first rear wheel inside face (132) thereon and a second rear wheel (140) having a second axle mount (141) centrally located on an second rear wheel inside face (142). In some embodiments, the system (100) comprises a first rear wheel (130) having a first axle mount (131) affixedly located on a first rear wheel inside face (132) thereon and a second rear wheel (140) having a second axle mount (141) affixedly located on an second rear wheel inside face (142). In some embodiments, the first rear wheel (130) is located on the rear axle first end (121) via the first axle mount (131) and the second rear wheel (140) is located on the rear axle second end (122) via the second axle mount (141). In some embodiments, the first wheel (130) is securely attached to the first axle mount (131) on the first wheel inside face (132). In some embodiments, the first axle mount (131) is securely attached to the rear axle first end (121). In some embodiments, the second wheel (140) is securely attached to the second axle mount (141) on the second wheel inside face (142). In some embodiments, the second axle mount (141) is securely attached to the rear axle second end (122).

In some embodiments, the system (100) comprises a motor (150) centrally located in the chassis (110) therein operatively connected to the rear axle central drive attachment (123). In some embodiments, the motor (150) is operatively connected to a power source (151). In some embodiments, the power source (151) is centrally located in the chassis (110). In some embodiments, the power source (151) is a direct current battery.

In some embodiments, the system (100) comprises a pivoting front steering apparatus (160) located on the chassis anterior edge (111). In some embodiments, the pivoting front steering apparatus (160) comprises a free rolling front wheel (161) located on a pivoting front steering apparatus bottom (162). In some embodiments, the pivoting front steering apparatus (160) pivots in a plane (163) parallel to a ground surface. In some embodiments, the pivoting front steering apparatus (160) rotates in a 45 degree arc. In some embodiments, the pivoting front steering apparatus (160) rotates in a 60 degree arc. In some embodiments, the pivoting front steering apparatus (160) rotates in a 75 degree arc. In some embodiments, the pivoting front steering apparatus (160) rotates in a 90 degree arc. In some embodiments, the pivoting front steering apparatus (160) rotates in a 120 degree arc. In some embodiments, the pivoting front steering apparatus (160) rotates in a 150 degree arc. In some embodiments, the pivoting front steering apparatus (160) rotates in a 180 degree arc.

In some embodiments, the system (100) comprises a front body section (170) having a resemblance to a horse head, chest, shoulders and front legs located over and attached to the pivoting front steering apparatus (160). In some embodiments, the front body section (170) comprises a rein (171) located around a front body section anterior end (172). In some embodiments, the rein (171) is for pivoting the front body section (170) and the attached pivoting front steering apparatus (160). In some embodiments, the front body section (170) comprises a convexly cylindrically rounded front body section posterior end (173). In some embodiments, the rein (170) comprises two reins connected to a bridle located over a muzzle area of the front body section (170).

In some embodiments, the system (100) comprises a rear body section (180) having a resemblance to a horse mid body section, barrel, hips, and rear legs having rear body first side (181) and a rear body second side (182), a rear body top (183), and a rear body bottom (184). In some embodiments, the rear body section (180) is located over and pivotally attached to a chassis top (113).

In some embodiments, the rear body section (180) comprises a concavely cylindrically rounded rear body section anterior end (185). In some embodiments, the concavely cylindrically rounded rear body section anterior end (185) is located close to the convexly cylindrically rounded front body section posterior end (173) and has an even gap (310) located in between. In some embodiments, there is a 0.25 inch gap (310) between the concavely cylindrically rounded rear body section anterior end (185) and the convexly cylindrically rounded front body section posterior end (173). In some embodiments, there is a 0.50 inch gap (310) between the concavely cylindrically rounded rear body section anterior end (185) and the convexly cylindrically rounded front body section posterior end (173). In some embodiments, there is a 0.75 inch gap (310) between the concavely cylindrically rounded rear body section anterior end (185) and the convexly cylindrically rounded front body section posterior end (173). In some embodiments, there is a 1.00 inch gap (310) between the concavely cylindrically rounded rear body section anterior end (185) and the convexly cylindrically rounded front body section posterior end (173). In some embodiments, the gap (310) provides unobstructed movement for the pivoting front steering apparatus (162) and the front body section (170) with respect to the rear body section (180). In some embodiments, the gap (310) is minimized to provide a uniform appearance upon a user viewing the front body section (170) and the rear body section (180) that resembles a horse.

In some embodiments, a seat (190) is located on the rear body top (183). In some embodiments, a first platform (186) is located on the rear body first side (181) close to the rear body bottom (184). In some embodiments, a second platform (187) is located on the rear body second side (182) close to the rear body bottom (184).

In some embodiments, the system (100) comprises an operating lever (200) operatively connected to the motor (150). In some embodiments, the operating lever (200) is located on either the first platform (186) or the second platform (187). In some embodiments, the operating lever (200) is attached via screws or a snap mechanism.

In some embodiments, a user sits on the seat (190). In some embodiments, the user activates the operating lever (200) to provide power to the motor (150). In some embodiments, the motor (150) propels the system (100) via empowering the first rear wheel (130) and the second rear wheel (140). In some embodiments, the system (100) is guided via the pivoting front steering apparatus (160) and the front wheel (161).

In some embodiments, a speaker (210) is operatively connected to the operating lever (200). In some embodiments, the speaker (210) emits a horse related sound during operation.

In some embodiments, a first adjustable eccentric axle mount (220) is centrally located on the first axle mount (131) and a second adjustable eccentric axle mount (230) is centrally located on the second axle mount (141). In some embodiments, the first adjustable eccentric axle mount (220) is adapted to be adjusted to provide eccentric mounting for the first rear wheel (130). In some embodiments, the second adjustable eccentric axle mount (230) is adapted to be adjusted to provide eccentric mounting for the second rear wheel (140) to simulate an undulating motion for the system (100) during operation for the user located on the pivotally attached rear body section (180). In some embodiments, the first adjustable eccentric axle mount (220) and the second adjustable eccentric axle mount (230) are adjusted manually via a spring biased (330) button located on each to change the position of an aperture (320) receiving the respective axle end (121, 122) thereon moving the aperture (320) off center from a position of concentricity to a position of eccentricity. In some embodiments, there are three positions of eccentricity. In some embodiments, there are more than three positions of eccentricity, for example, four, five, or infinite positions of eccentricity.

In some embodiments, the first adjustable eccentric axle mount (220) is remotely adjustable via a switch (240) or a lever. In some embodiments, the second adjustable eccentric axle mount (230) is remotely adjustable via a switch (240) or a lever. In some embodiments, the switch is operatively attached to a power source and a motor for driving an automated worm gear driven adjustment (300) located thereon. In some embodiments, the switch (240) activates the automated worm gear driven adjustment (300) via a radio signal. In some embodiments, the switch (240) activates the automated worm gear driven adjustment (300) via electrical contacts.

In some embodiments, the first adjustable eccentric axle mount (220) is adapted to be clocked 180 degrees from the second adjustable eccentric axle mount (230) to simulate an even, offsetting undulating motion for the system (100). In some embodiments, the first adjustable eccentric axle mount (220) is adapted to be clocked 90 degrees from the second adjustable eccentric axle mount (230).

In some embodiments, the rear axle (120) comprises a first crank (250) located on an axle first side (270) and a second crank (260) located on an axle second side (280). In some embodiments, the first crank (250) is rigidly pivotally connected to a chassis (110) proximal to the rear body first side (181) via a first rod (251). In some embodiments, the first crank (250) is connected to the chassis (110) proximal to the rear body first side (181) via a bushing or a ball and socket joint on the first rod (251). In some embodiments, the second crank (260) is rigidly pivotally connected to a chassis (110) proximal to the rear body second side (182) via a second rod (261). In some embodiments, the second crank (260) is connected to the chassis (110) proximal to the rear body second side (182) via a bushing or a ball and socket joint on the second rod (261). In some embodiments, the first rod (251) is located on the first crank (250) via a first rod second end (253) via a friction reducing means such as a bearing or a bushing. In some embodiments, the second rod (261) is located on the second crank (260) via a second rod second end (263) via a friction reducing means such as a bearing or a bushing. In some embodiments, the first crank (250) and the second crank (260) are adapted to simulate an undulating motion for the system (100) during operation for the user sitting on the pivotally attached rear body section (180) via the first rod (251) and the second rod (261) attached each using a pivoting means such as a bushing or a ball and socket to the pivotally attached rear body section (180). In some embodiments, the first crank (250) and the second crank (260) are mechanically adjustable to provide increased or decreased rates of force for the undulating motion. In some embodiments, the attachment for the first rod (251) and the second rod (261) to the pivotally attached rear body section (180) is able to be engaged and disengaged manually via a spring loaded button, or automatically using a switch connected to a servo powered by a power supply to engage or disengage the undulating motion for the system (100) during operation for the user.

In some embodiments, the seat (190) is a saddle.

In some embodiments, the rear body section (180) is pivotally mounted on the chassis top (113) via a ball and socket joint. In some embodiments, the rear body section (180) is pivotally mounted on the chassis top (113) via a plurality of ball and socket joints.

In some embodiments, the operating lever (200) is attachable to and detachable from the first platform (186) and the second platform (187) depending on the location preference of the user. For example, the operating lever (200) can be relocated to the opposing side.

In some embodiments, the first rear wheel (130), the second rear wheel (140), and the front wheel (161) comprise spongy tires (290) located thereon.

In some embodiments, the first rear wheel (130), the second rear wheel (140), and the front wheel (161) comprise tires (290) constructed from a rubber compound located thereon.

In some embodiments, the system (100) comprises a first rear wheel (130) having a first adjustable eccentric axle mount (220) disposed on a first rear wheel inside face (132) thereon and a second rear wheel (140) having a second adjustable eccentric axle mount (230) disposed on a second rear wheel inside face (142) thereon. In some embodiments, the first adjustable eccentric axle mount (220) is adapted to be adjusted to provide eccentric mounting for the first rear wheel (130). In some embodiments, the second adjustable eccentric axle mount (230) is adapted to be adjusted to provide eccentric mounting for the second rear wheel (140) to simulate an undulating motion for the system (100) during operation for the user disposed on the pivotally attached rear body section (180). In some embodiments, the first adjustable eccentric axle mount (220) and the second adjustable eccentric axle mount (230) each comprise a sliding block (340) having an aperture (320) adapted to receive the respective axle end (121, 122) disposed therein. In some embodiments, the sliding block is adjusted manually via a spring biased button (330)

disposed thereon, engaging a receiving aperture disposed on either the first adjustable eccentric axle mount (220) or the second adjustable eccentric axle mount (230) to change the position of the aperture (320) receiving the respective axle end (121, 122) thereon moving the aperture (320) off center from a position of concentricity to a position of eccentricity. In some embodiments, there are at least three positions of eccentricity. In some embodiments, the first rear wheel (130) is affixedly disposed on the rear axle first end (121) and the second rear wheel (140) is affixedly disposed on the rear axle second end (122).

In some embodiments, the first adjustable eccentric axle mount (220) is remotely adjustable via a switch (240) or a lever. In some embodiments, the second adjustable eccentric axle mount (230) is remotely adjustable via the switch (240) or the lever. In some embodiments, the switch (240) is operatively attached to an automated worm gear driven adjustment (300) disposed on the first adjustable eccentric axle mount (220) and the second adjustable eccentric axle mount (230) each having a worm gear power source (306) and a worm gear motor (304) located therein. In some embodiments, the switch (240) activates the automated worm gear driven adjustment (300) via a radio signal or direct connection. In some embodiments, the automated worm gear driven adjustment comprises a worm gear (302) adapted to engage the sliding block (340).

In some embodiments, the system (100) comprises a first rear wheel (130) having a first axle mount (131) centrally disposed on an first rear wheel inside face (132) thereon and a second rear wheel (140) having a second axle mount (141) centrally disposed on an second rear wheel inside face (142) thereon. In some embodiments, the first rear wheel (130) is affixedly disposed on the rear axle first end (121) via the first axle mount (131) and the second rear wheel (140) is affixedly disposed on the rear axle second end (122) via the second axle mount (141). In some embodiments, the rear axle (120) comprises a first crank (250) disposed on a rear axle first side (270) thereon, and a second crank (260) disposed on a rear axle second side (280) thereon. In some embodiments, the first crank (250) is pivotally connected to the chassis (110) proximal to the rear body first side (181) via a first end (252) of a first rod (251). In some embodiments, the second crank (260) is pivotally connected to the chassis (110) proximal to the rear body second side (182) via a first end (262) of a second rod (261). In some embodiments, the first rod (251) is disposed on the first crank (250) via a first rod second end (253) via a friction reducing means. In some embodiments, the second rod (261) is disposed on the second crank (260) via a second rod second end (263) via a friction reducing means. In some embodiments, the first crank (250) and the second crank (260) are adapted to simulate an undulating motion for the system (100) during operation for the user disposed on the pivotally attached rear body section (180) via the first rod (251) and the second rod (261) pivotally attached to the pivotally attached rear body section (180).

As used herein, the term "about" refers to plus or minus 10% of the referenced number.

The disclosures of the following U.S. Patents are incorporated in their entirety by reference herein: U.S. Pat. No. D 267,727; U.S. Patent Pub. No. 2007/0287139; U.S. Patent Pub. No. 2007/0114731; U.S. Pat. No. 6,412,787; U.S. Pat. No. 4,988,300; U.S. Pat. No. 4,957,444; U.S. Pat. No. 4,657,098; U.S. Pat. No. 4,289,307; U.S. Pat. No. 2,885,213; and U.S. Pat. No. 2,195,824.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A horse riding simulation system (100) for providing a riding experience that resembles riding a horse, wherein the system (100) comprises:

(a) a chassis (110) having a chassis anterior edge (111) and a chassis posterior edge (112), wherein the chassis (110) comprises a rear axle (120) disposed proximal to the chassis posterior edge (112) thereon, wherein the rear axle (120) comprises a rear axle first end (121), a rear axle second end (122), and a centrally disposed rear axle central drive attachment (123);

(b) a first rear wheel (130) having a first axle mount (131) and a second rear wheel (140) having a second axle mount (141), wherein the first rear wheel (130) is affixedly disposed on the rear axle first end (121) via the first axle mount (131) and the second rear wheel (140) is affixedly disposed on the rear axle second end (122) via the second axle mount (141);

(c) a motor (150) centrally disposed in the chassis (110) therein operatively connected to the rear axle central drive attachment (123), wherein the motor (150) is operatively connected to a power source (151), wherein the power source (151) is centrally disposed in the chassis (110);

(d) a pivoting front steering apparatus (160) disposed on the chassis anterior edge (111), wherein the pivoting front steering apparatus (160) comprises a free rolling front wheel (161) disposed on a pivoting front steering apparatus bottom (162) thereon, wherein the pivoting front steering apparatus (160) pivots in a plane (163) parallel to a ground surface;

(e) a front body section (170) having a resemblance to a horse head, chest, shoulders and front legs disposed over and attached to the pivoting front steering apparatus (160), wherein the front body section (170) comprises a rein (171) disposed around the front body section anterior end (172) thereon, wherein the rein (171) is for pivoting the front body section (170) and the attached pivoting front steering apparatus (160), wherein the front body section (170) comprises a convexly cylindrically rounded front body section posterior end (173);

(f) a rear body section (180) having a resemblance to a horse mid body section, barrel, hips, and rear legs having rear body first side (181) and a rear body second side (182), a rear body top (183), and a rear body bottom (184), wherein the rear body section (180) is disposed over and attached to a chassis top (113), wherein the rear body section (180) comprises a concavely cylindrically rounded rear body section anterior end (185), wherein the concavely cylindrically rounded rear body section anterior end (185) is disposed proximal to the convexly cylindrically rounded front body section posterior end (173) having an even gap (310) disposed between the convexly cylindrically rounded front body section posterior end (173) and the concavely cylindrically rounded rear body section anterior end (185), wherein a seat (190) is disposed on the rear body top (183) thereon, wherein a first platform (186) is disposed on the rear body first side (181) proximal to the rear body bottom (184), wherein a second platform (187) is disposed on the rear body second side (182) proximal to the rear body bottom (184); and (g) an operating lever (200) operatively connected to the motor (150), wherein the operating lever (200) is disposed on either the first platform (186) or the second platform (187);

wherein the operating lever (200) is activated to provide power to the motor (150), wherein the motor (150) propels the system (100) via empowering the first rear wheel (130) and the second rear wheel (140), wherein the system (100) is guided via the pivoting front steering apparatus (160) and the front wheel (161);

wherein the rear axle (120) comprises a first crank (250) disposed on a rear axle first side (270) thereon, and a second crank (260) disposed on a rear axle second side (280) thereon, wherein the first crank (250) is pivotally connected to a bottom of the chassis (110) proximal to the rear body first side (181) via a first end (252) of a first rod (251), wherein the second crank (260) is pivotally connected to the bottom of the chassis (110) proximal to the rear body second side (182) via a first end (262) of a second rod (261), wherein the first rod (251) is disposed on the first crank (250) via a first rod second end (253) via a friction reducing means, wherein the second rod (261) is disposed on the second crank (260) via a second rod second end (263) via a friction reducing means, wherein the first crank (250) and the second crank (260) are adapted to simulate a undulating motion for the system (100) during operation for the user disposed on the attached rear body section (180) via the first rod (251) and the second rod (261); and wherein the first crank (250) protrudes away from the rear axle first side (270) and the second crank (260) protrudes away from the rear axle second side (280), wherein a lateral direction is parallel to the rear axle first side (270) and rear axle second side (280), wherein the first crank (250) protrudes in a direction that is 180° opposite the second crank (260) such that when the first crank (250) and the second crank (260) rotate, the first crank (250) and the second crank (260) take turn going up and down to simulate a laterally tilting and undulating motion for the system (100) during operation for the user disposed on the pivotally attached rear body section (180).

2. The system (100) of claim 1, wherein a speaker (210) is operatively connected to the operating lever (200), wherein the speaker (210) emits a horse related sound during operation.

3. The system (100) of claim 1, wherein the seat (190) is a saddle.

4. The system (100) of claim 1, wherein the operating lever (200) is attachable to and detachable from the first platform (186) and the second platform (187) depending on the location preference of the user.

5. The system (100) of claim 1, wherein the first rear wheel (130), the second rear wheel (140), and the front wheel (161) comprise spongy tires (290) disposed thereon.

6. The system (100) of claim 1, wherein the first rear wheel (130), the second rear wheel (140), and the front wheel (161) comprise tires (290) constructed from a rubber compound disposed thereon.

* * * * *